United States Patent [19]

Porter

[11] 4,230,306

[45] Oct. 28, 1980

[54] SELF-TAILING WINCH

[75] Inventor: Raymond J. Porter, Panania, Australia

[73] Assignee: Barlow Marine Limited, New South Wales, Australia

[21] Appl. No.: 13,309

[22] Filed: Feb. 21, 1979

[30] Foreign Application Priority Data

Feb. 21, 1978 [AU] Australia ..... PD3463
Oct. 16, 1978 [AU] Australia ..... PD6382

[51] Int. Cl.[3] ..... B66D 1/30
[52] U.S. Cl. ..... 254/371; 114/109
[58] Field of Search ..... 254/150 R, 175.7, 138, 254/186 HC, 175.3, 175.5, 175.6, 191; 114/218; 74/230.24, 230.7; 24/132 R, 115 R

[56] References Cited

U.S. PATENT DOCUMENTS

| | | | |
|---|---|---|---|
| 3,730,483 | 5/1973 | Newell | 254/150 R |
| 3,934,482 | 1/1976 | Byers | 254/138 X |
| 4,143,855 | 3/1979 | Burton et al. | 254/150 R |
| 4,151,980 | 5/1979 | Burton et al. | 254/150 R |

*Primary Examiner*—John M. Jillions
*Attorney, Agent, or Firm*—Stevens, Davis, Miller & Mosher

[57] ABSTRACT

A self-tailing winch of the type having a stationary frame and a rotatable drum. The tail of the rope or sheet is held in a groove between a pair of toroidal shaped gripping diaphrams of elastomeric material. There is a free space between each diaphram and the surface behind it whereby initial feeding of the sheet deflects the diaphrams into the free spaces. As the sheet moves toward the root of the groove, the resultant filling of the groove distorts the diaphrams against a greater reactive force.

6 Claims, 14 Drawing Figures

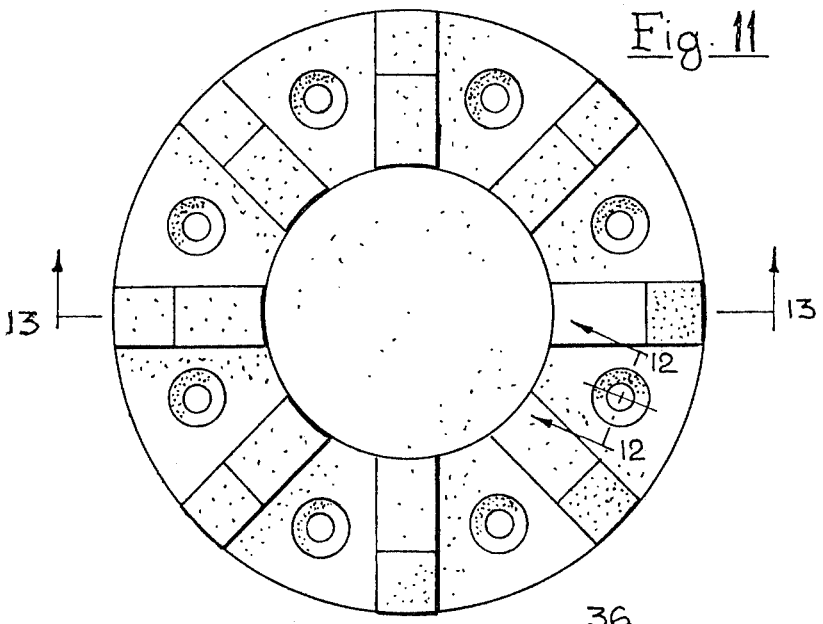
Fig. 11
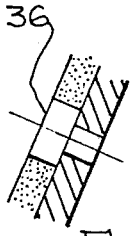
Fig. 12
Fig. 13
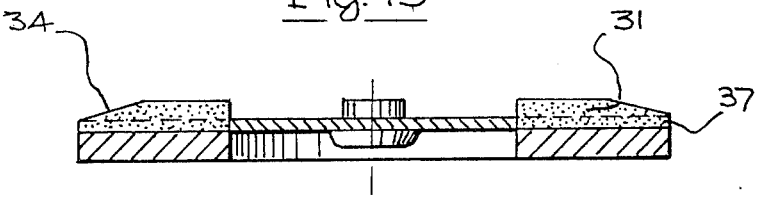

SELF-TAILING WINCH

This invention relates to winches, and more particuarly to marine winches of the kind used to manipulate the sheets of sails or the like.

It is known to construct marine winches wherein a suitable reduction gear is located so that a handle turned by an operator gives a desired speed to a drum which is connected to said reduction gear.

It is a problem, when winding in a sheet with the aid of such a drum, to be able to cleat said sheet (i.e. hold it) and also to be able to ease it as it comes off the drum, which is meanwhile being wound by said handle.

Attempts have been made to solve this problem simply by having, in addition to the operator of the handle, an extra operator who secures and hauls in the spare end of the sheet and who, if necessary, cleats it so as to prevent it from sliding back around the drum, especially at those times when extra strain is put upon the sheet due to an increase in load imparted, for example, by a sail.

However, it is clearly a disadvantage to employ two operators to control the same winch, especially on board a racing yacht or the like, where the weight factor is critical.

It is an object of the present invention to overcome the above and other disadvantages, and to provide self-tailing and self-cleating means in winches of the above-mentioned kind, thereby rendering them capable of operation with ease by a sole operator.

It is a further object of the invention to ensure that the self-tailing facility, so provided, is adapted for use with a range of different sized sheets.

Accordingly the invention comprises, in a self-tailing winch for a sheet of the kind having in combination a stationary frame, a rotatable input shaft supported by said frame, a rotatable drum supported by said frame, a reduction gear train connecting said input shaft to said drum so that said drum is driven by said shaft, sheet gripping means attached to and axially aligned with the upper end of said drum for rotation therewith, said gripping means having inner annular surfaces defining an annular groove between them, whereby said groove defines a constant winding diameter for said sheet, said groove having an effective root diameter substantially equal to or less than the winding diameter of said drum, a stationary member anchored to said frame near the top of said drum, and sheet deflector means supported by said stationary member and adapted to feed a sheet from said drum to said groove, the improvement wherein said gripping means comprises a pair of juxtaposed toroidal gripping diaphragms each composed substantially of elastomeric material, said diaphragms abutting respectively, at least in part, a surface of said stationary member and a surface of support means co-extensive with said upper end of said drum, with a free space interposed between each said diaphragm and a respective one of said last-mentioned surfaces, whereby the initial feeding of said sheet to said groove deflects said diaphragms into the respective free spaces against a lesser reactive force, and whereby upon the resultant filling of said spaces the further motion of said sheet towards the root of said groove distorts said diaphragms against a greater reactive force.

Certain particular embodiments of the invention will now be described herein with reference to the accompanying drawings, in which similar references indicate corresponding parts, and in which:

FIG. 1 shows schematically, in front elevation, a section through the top portion of a winch, FIG. 2 shows the apparatus of FIG. 1 with a large sheet engaged thereby, FIG. 3 shows a similar view with a smaller sheet engaged, FIG. 4 shows a modified, practical embodiment of the apparatus of FIGS. 1 to 3, FIG. 5 shows schematically, in front elevation, a section through a second modification of the top portion of a winch, FIG. 6 shows schematically, a plan view of a sheet gripping diaphragm, FIG. 7 shows schematically a median section through the apparatus of FIG. 6, FIG. 8 shows schematically a developed sectional view of said sheet gripping diaphragm, FIG. 9 shows the apparatus of FIG. 8 when gripping a larger sheet, FIG. 10 shows schematically a developed sectional view of a modification of the apparatus of FIGS. 8 and 9, FIG. 11 shows schematically, in plan view, a modification of the apparatus of FIG. 6, FIG. 12 shows schematically a scrap section along the line 12—12 of FIG. 11, FIG. 13 shows schematically a scrap section along the line 13—13 of FIG. 11, and FIG. 14 shows schematically, in front elevation, a section through a third modification of the top portion of a winch.

Upon referring to the drawings it will be seen that FIG. 1 shows a cross-section taken near the top of a typical winch, including part of its drum. Here, only the means for gripping and feeding the sheet is shown. The means for guiding the sheet into the gripping position, and the means for extracting the sheet from the gripping means, will be apparent to those skilled in the art.

Figure 1:
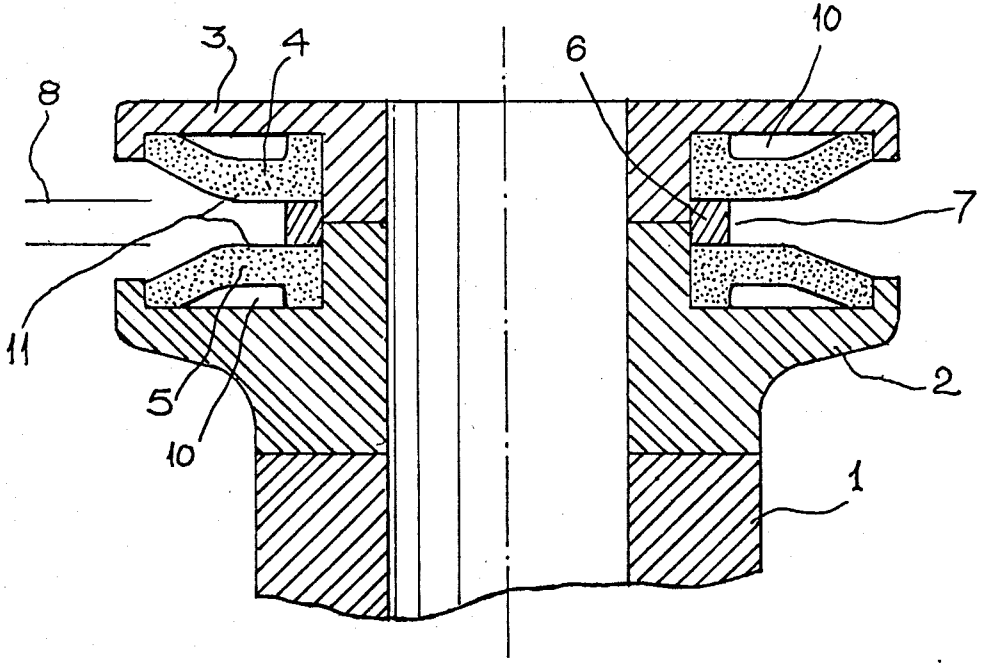

In particular, in FIG. 1 a winch drum 1 has affixed thereto, by any suitable means, a lower gripping mount 2 and an upper gripping mount 3. Located in said gripping mounts are the toroidal gripping diaphragms 4 and 5. These gripping diaphragms 4 and 5 may be attached to the gripping mounts 3 and 2, respectively, by cementing, glueing, bonding, or mechanical means, as will be evident to those skilled in the art. Situated between the gripping diaphragms 4 and 5 is a datum ring 6, having an exterior cylindrical face 7 whose diameter is equal to, or less than, the diameter of the winch drum 1.

Reasons for the indicated cross-sectional shape of the toroidal gripping diaphragms 4 and 5 are now given herein. Reference to FIG. 1 will disclose that the juxtaposition of gripping diaphragms 4 and 5 offers to an incoming sheet a configuration similar to the gripping groove in a commerical "vee pulley". This configuration is not, however, designed to grip the sheet, but to afford an easy ingress to the gripping portion 8, a section through said portion being substantially paralled-sided. The gripping diaphragms 4 and 5 are made of a resilient material such as rubber, or some other suitable elastomer, which is preferably resistant to sea-water, oil, ozone and ultra-voilet light.

Figure 2:
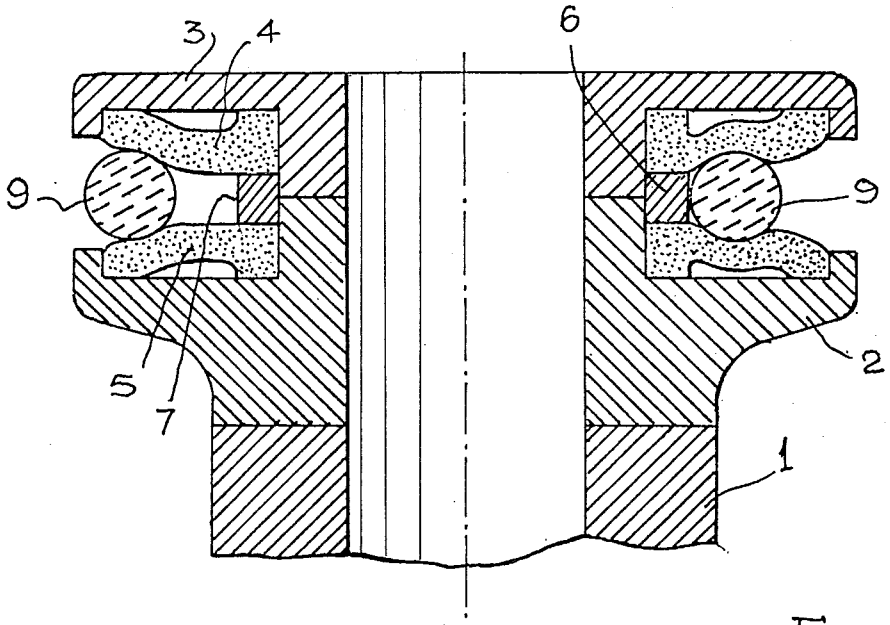
FIG. 2 shows, on the left hand of the vertical centre line, a large size sheet effecting its entry between the gripping and feeding elements, while on the right hand side of the drawing the same sheet is shown in its tractive position.

Reference to the left hand side of FIG. 2 will disclose a large-size sheet 9 moving inwardly towards the datum ring 6. It will be seen that because of the free space 10 designated in FIG. 1, the gripping diaphragms 4 and 5 are able to yield and afford an easy transition, even for a large sheet, to the gripping portion 8. Reference to the right hand side of FIG. 2 will disclose the sheet 9 abutting against the cylindrical face 7 of the datum ring 6, and gripped between the gripping faces 11 (which form the gripping space 8 of FIG. 1). The gripping diaphragms 4 and 5 are made of an elastomer having a sufficiently high co-efficient of friction to ensure that, in combination with the re-active force occasioned by their distortion, a sufficient grip is obtained on the sheet to cause it to "tail-out".

Figure 3:
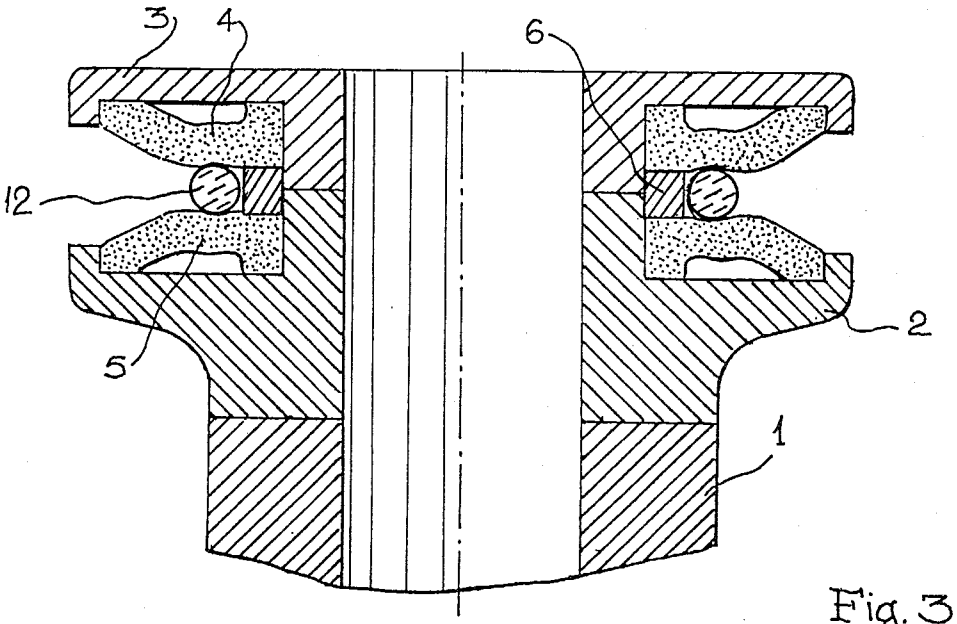
FIG. 3 shows details as in FIG. 2, except that it depicts the use and function of a small sheet.

Reference to FIG. 3 will disclose a small sheet 12 in the functioning, that is, the "tailing-out" position. It will be observed that the distortion to the gripping diaphragms is minimal; hence the tractive force exerted on the sheet is less than what is obtained when a large sheet is used. Tests leading to the present invention have shown that this set of conditions is satisfactory, as small sheets require less tractive effort than do large sheets.

Figure 4:
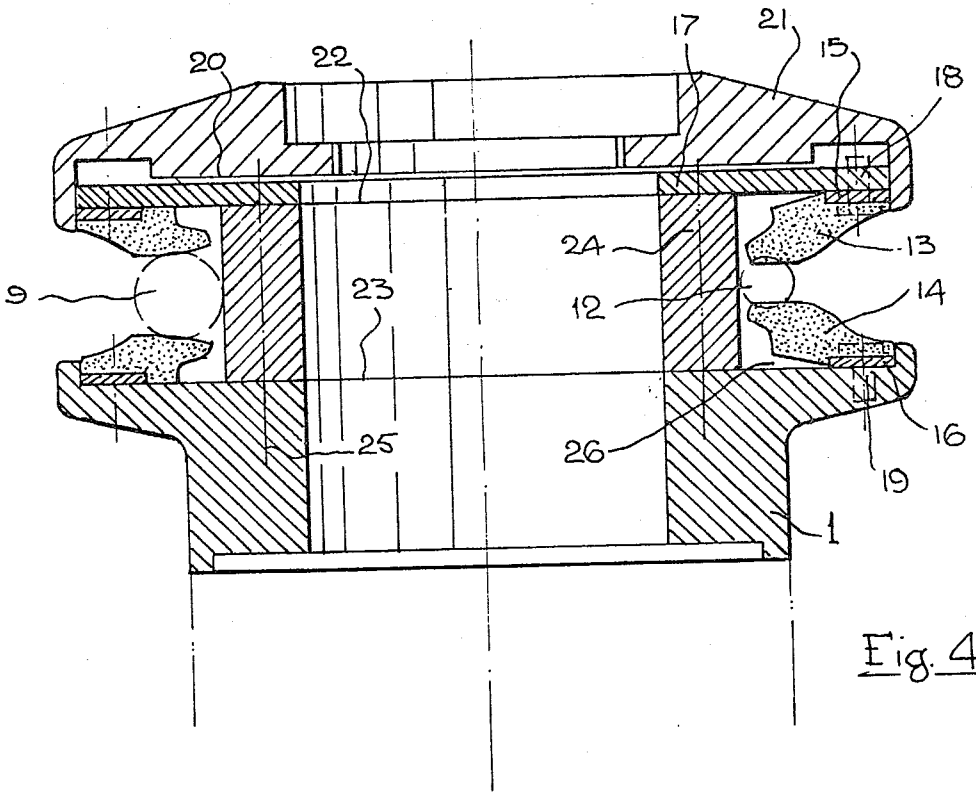
Figure 5:
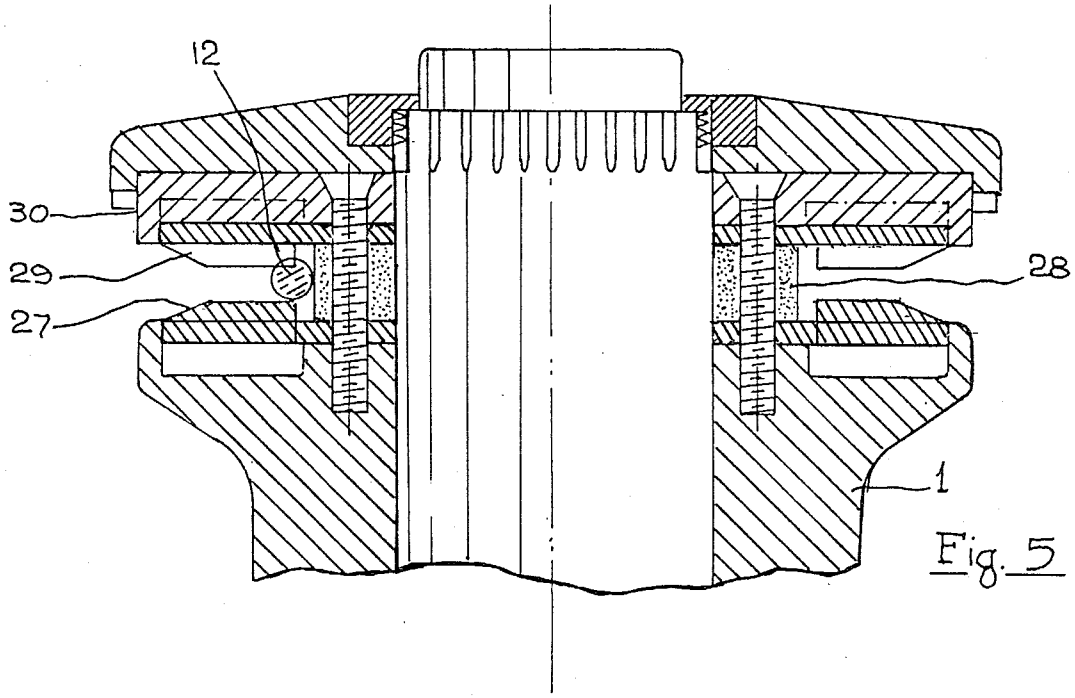

In FIG. 4, showing a practical form of the invention, the gripping diaphragms 13 and 14 are bonded to the respective gripping mounts 15 and 16, which are in turn fastened respectively to the mounting plate 17 and the upper lip of the drum 1 by screws such as 18,19. Pre-assembly breaks are located at the line 20 between cover plate 21 and mounting plate 17, and at the line 22 between mounting plate 17 and ring 24, and also at the line 23 between the bottom of ring 24 and the top of the drum 1. The sub-assemblies may then be fastened by screws in the positions such as 25.

The wedge-shaped displacement area shown at 26 is then filled by flexure of the gripping diaphragms 13,14 at a relatively low "rate" as a sheet enters therebetween, followed by further slight distortion of the diaphragms at a relatively higher rate.

The inner or free edges of the diaphragms are preferably given a slight reversed slope upon their gripping surfaces, as shown, so that a mild inwardly radially resolved component of the axial reactive force of the disphragms is imparted to the sheet. Thus the apparatus could be expected to operate marginally, even in the absence of any friction at the gripping surfaces. The result is an enhanced tendency for the sheet to wrap in against the outer surface of ring 24 during tailing. At other times the radially inward force is too small to interfere with the necessary manual or other extraction of the sheet.

It is stressed that this invention achieves the "self-tailing" function in a manner distinguished from that of prior art winches known to the inventor. These latter have had, in common, driving jaws which depended for their efficiency on being similar to a "vee pulley". By contrast, the present invention does not. Prior systems have had resiliently loaded moving jaws, or "vee pulley" form jaws which were not slidably mounted. The present invention does not. Prior systems also depended, for their traction efficiency, on grooves or ridges in the jaws, and these grooves or ridges tended to mutilate the sheet. The present invention needs no such grooves or ridges, but uses, as aforesaid, the combination of pressure and a high co-efficient of friction to obtain tractive force on the sheet, this being done between faces which are substantially parallel.

Nevertheless, vestigial radial grooves may be provided in the gripping surfaces, if desired, for their cosmetic effect.

Figure 6:
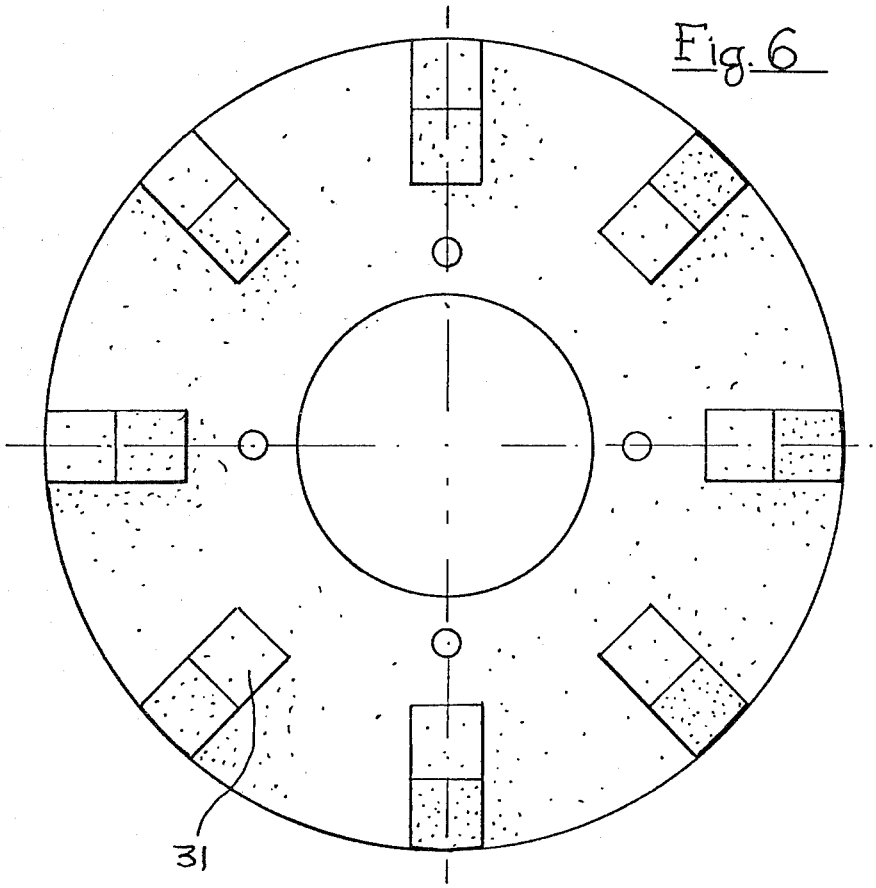
Figure 7:
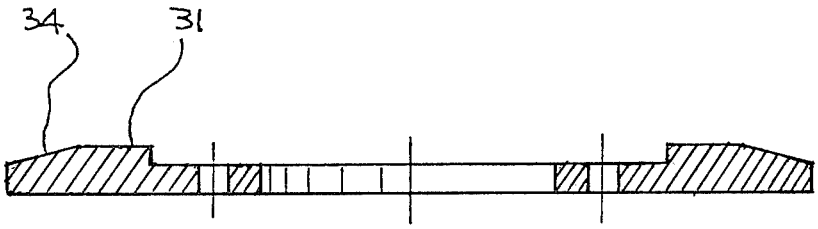

Upon referring to FIGS. 5 to 9 of the drawings, showing a second modification of the invention, it will be seen that a winch drum 1, journally located a gripping diaphragm 27, of the form shown in FIGS. 6 and 7. A cylindrical member 28 of diameter equal to, or less than, the diameter of drum 1, is interposed between the gripping diaphragm 27 and a second gripping diaphragm 29. The latter is housed within a housing 30, and all the items 27 through 30 inclusive are attached by screws (or other equivalent fastening means) to the winch drum 1. By comparing FIGS. 5, 6, 7 and 8 it will be seen that the gripping diaphragms 27 and 29 are disposed relative to each other so that all the raised portions 31 assemble in a staggered pattern, raised portions 31 of gripping diaphragm 29 falling mid-way between raised portions 31 on gripping diaphragm 27. It will also be seen that said raised portions assemble immediately opposite recesses 32 and 33 in housing 30 and drum 1 respectively.

Gripping diaphragms 27 and 29 are made with an inclined face 34 to assist the transition of the sheet 12 from the drum 1 into its working position between the gripping diaphragms 27 and 29.

Essential to this embodiment of the invention is the fact that the gripping diaphragms 27 and 29 be made of an elastomeric material having not only a high co-efficient of friction as above described, but also high ductility and adequate tensile and shear strength.

Figure 8:
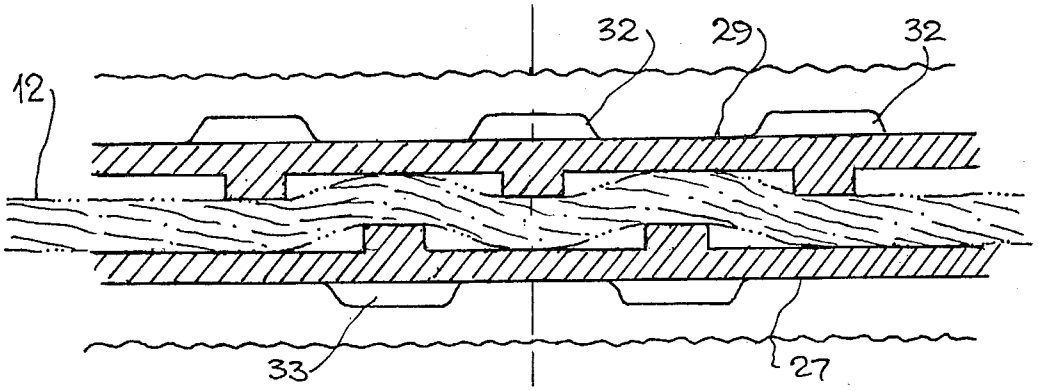

Referring to FIG. 8 it will be seen that a small sheet such as 12 will follow a serpentine track between gripping diaphragms 27 and 29; the friction occasioned at the points of contact, combined with a minimal distortion of the raised portions 31, will generate a sufficient tractive effort on the sheet for this application.

Figure 9:
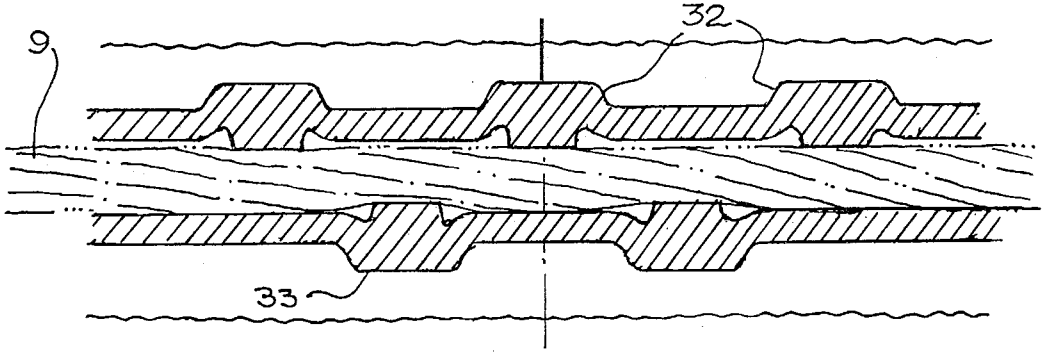

When larger sheets such as 9 are used, there will be a larger displacement of the raised portions 31 into the recesses 32, as depicted in FIG. 9. Thus, when a larger tractive effort is required, the gripping diaphragms (which may be bonded, glued or mechanically united with housing 30 and drum 1) are afforded extra conjunctive means because the means for displacement of the elastomer into the recesses 32 acts as a plurality of keys.

It will be seen, then, that tractive effort is applied to the sheet being used by the combination of the resilience of the gripping diaphragms 27 and 29, and the high co-efficient of friction of the elastomeric material of which said diaphragms are composed.

Figure 10:
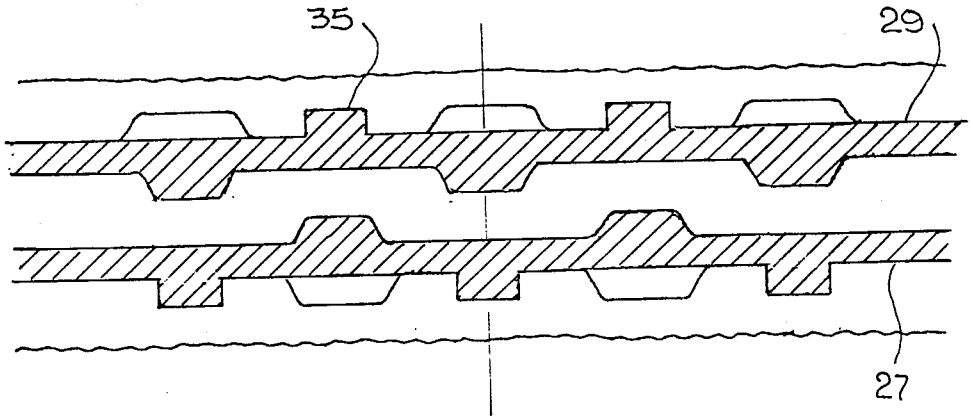

In a further modification of the invention depicted in FIG. 10, it will be seen that gripping diaphragms 29 and 27 may have a plurality of raised portions 35 on the face opposite to that bearing raised portions 31. These raised portions 35 are captively located in correspondingly shaped recesses in housing 30 and drum 1 and afford, at all times, a positive mechanical drive between diaphragms 29 and 27, and housing 30 and drum 1 respectively.

From the foregoing it will be clear that the gripping diaphragm 27 might readily be attached to a subsidiary member resembling the configuration of the top of drum 1. This would allow for easier replacement of gripping diaphragm 27 if the latter were attached to said member by the raised portions 35 than if bonding, adhesion, screwing or the like were used to secure gripping diaphragms 27 directly to drum 1.

Finally, it is stressed that the inclined faces 34 contribute nothing to the gripping action, and this embodiment of the invention has been designed as an improvement in similar devices where ropes were formerly gripped in a "vee-pulley" configuration of jaws (whether fixed or adjustable).

In a modification of the apparatus of FIG. 6, shown in FIGS. 11 to 13, it will be seen that countershaped holes such as 36 are provided to permit the attachment (by screws in this instance) of discrete metal strips or studs 31, which might be desirable for very arduous conditions. Alternatively, such metal strips or studs may be bonded, cemented or otherwise fixed to the plain band 37 of said elastomeric material.

Figure 14:
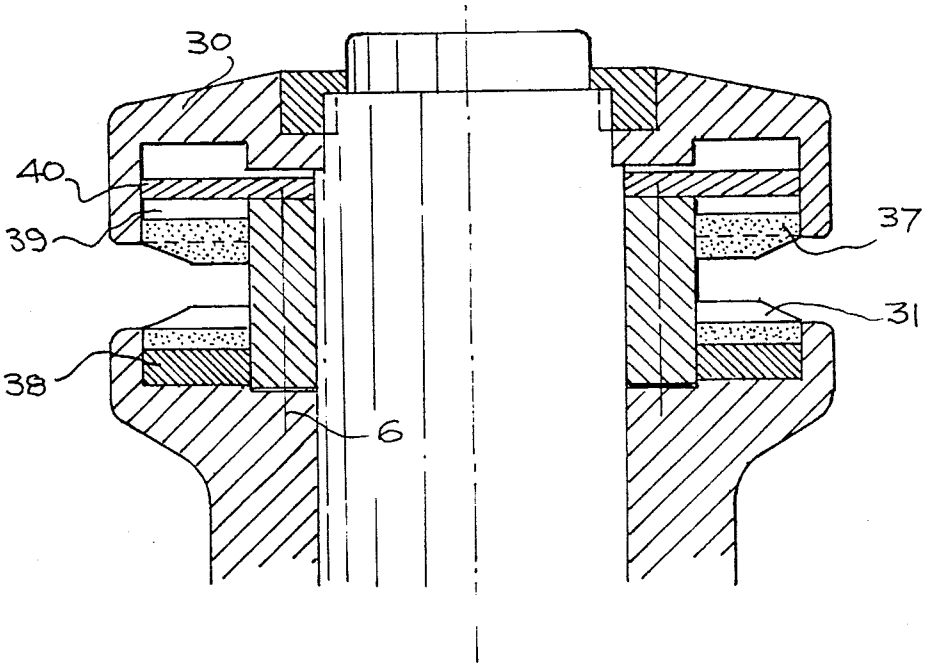

In a further simplified modification of the invention, shown in FIG. 14, the diaphragm assemblies have, as above described, a plain band such as 37 of rectangular cross-section, fitted with raised integral portions such as 31 as in FIGS. 6 and 7, with a recess 39 left within the housing 30 and bounded by the plate 40. The sub-assemblies may be secured as described with reference to FIG. 4, with raised portions 31 staggered as described with reference to FIG. 8.

The claims defining the invention are as follows:

1. In a self-tailing winch for a sheet of the kind having in combination a stationary frame, a rotatable input shaft supported by said frame, a rotatable drum supported by said frame, a reduction gear train connecting said input shaft to said drum so that said drum is driven by said shaft, sheet gripping means attached to and axially aligned with the upper end of said drum for rotation therewith, said gripping means having inner annular surfaces defining an annular groove between them, whereby said groove defines a constant winding diameter for said sheet, said groove having an effective root diameter substantially equal to or less than the winding diameter of said drum, a stationary member anchored to said frame near the top of said drum, and sheet deflector means supported by said stationary member and adapted to feed a sheet from said drum to said groove, the improvement wherein said gripping means comprises a pair of juxtaposed toroidal gripping diaphragms each composed substantially of elastomeric material, said diaphragms abutting respectively, at least in part, a surface of said stationary member and a surface of support means co-extensive with said upper end of said drum, with a free space interposed between each said diaphragm and a respective one of said last-mentioned surfaces, whereby the initial feeding of said sheet to said groove deflects said diaphragms into the respective free spaces against a lesser reactive force, and whereby upon the resultant filling of said spaces the further motion of said sheet towards the root of said groove distorts said diaphragms against a greater reactive force.

2. The winch claimed in claim 1, wherein said gripping diaphragms each possess a plurality of radial, raised portions in registration with respective discrete regions of said surfaces, said regions being recessed to encompass said free spaces, and wherein the raised portions of one said diaphragm are circumferentially staggered with respect to the raised portions of the other said diaphragm, whereby said raised portions constitute keys which force into a serpentine track a sheet gripped between said diaphragms.

3. The winch as claimed in claim 1 or claim 2, wherein the radially inner edges of the gripping diaphragms have a reversed slope contrary to that of said annular surfaces, to thereby urge said sheet, when gripped, towards the root of said groove.

4. The winch as claimed in claim 2 wherein said raised portions are formed integrally with their respective gripping diaphragms.

5. The winch as claimed in claim 2 wherein said raised portions are discrete structures bonded to their respective gripping diaphragms.

6. The winch as claimed in claim 2 wherein each said gripping diaphragm is mounted upon a sub-assembly which is removably attachable respectively to said stationary member and to the upper end of said drum.

* * * * *